US008434170B1

(12) United States Patent
Ramos

(10) Patent No.: US 8,434,170 B1
(45) Date of Patent: May 7, 2013

(54) TOILET VENTILATION SYSTEM

(76) Inventor: Ramon Ramos, Elkhart, IN (US)

( * ) Notice: Subject to any disclaimer, the term of this patent is extended or adjusted under 35 U.S.C. 154(b) by 0 days.

(21) Appl. No.: 13/290,720

(22) Filed: Nov. 7, 2011

Related U.S. Application Data

(63) Continuation-in-part of application No. 12/380,876, filed on Mar. 4, 2009, now abandoned.

(51) Int. Cl.
*E03D 9/04* (2006.01)

(52) U.S. Cl.
USPC ..... 4/213; 4/216; 4/218; 4/348

(58) Field of Classification Search ..... 4/213, 211, 4/216, 218, 348, 349, 350, 351
See application file for complete search history.

(56) References Cited

U.S. PATENT DOCUMENTS 2,824,313 A * 2/1958 Bulow ..... 4/213
3,357,029 A * 12/1967 Schulz ..... 4/217
3,849,808 A * 11/1974 Olson et al. ..... 4/213
3,887,949 A * 6/1975 Osmond ..... 4/217
3,913,150 A 10/1975 Poister et al.
3,916,459 A * 11/1975 Ivancevic ..... 4/213
3,942,200 A 3/1976 Pearson
4,059,857 A * 11/1977 Poister ..... 4/213
4,085,470 A * 4/1978 Roberts ..... 4/213
4,117,559 A * 10/1978 Boyle ..... 4/209 R
4,125,906 A 11/1978 Weiland
4,168,553 A * 9/1979 Studer ..... 4/348
4,175,293 A * 11/1979 Stephens et al. ..... 4/209 R
4,251,888 A * 2/1981 Turner ..... 4/213
4,365,361 A * 12/1982 Sanstrom ..... 4/213
4,375,704 A * 3/1983 Smith ..... 4/213
4,556,999 A * 12/1985 Lindley ..... 4/217
4,701,966 A * 10/1987 Schafer ..... 4/213
4,726,078 A 2/1988 Carballo et al.
4,780,913 A * 11/1988 Williams ..... 4/217
4,882,790 A 11/1989 Ricard
5,054,130 A * 10/1991 Wilson ..... 4/213
5,170,512 A * 12/1992 Prisco ..... 4/213
5,199,111 A * 4/1993 Antepenko ..... 4/213
5,355,536 A * 10/1994 Prisco ..... 4/217
5,555,572 A * 9/1996 Hunnicutt, Jr. ..... 4/213
5,590,423 A * 1/1997 Boykin ..... 4/213
5,638,553 A * 6/1997 Loewen et al. ..... 4/217
5,671,484 A * 9/1997 Lee, III ..... 4/213
5,819,324 A * 10/1998 Bianco ..... 4/213
5,875,496 A * 3/1999 Schaffer ..... 4/213
6,016,576 A * 1/2000 Happe ..... 4/213
6,233,750 B1 * 5/2001 Donald et al. ..... 4/213

(Continued)

*Primary Examiner* — Brian Glessner
*Assistant Examiner* — Joshua Ihezie
(74) *Attorney, Agent, or Firm* — Botkin & Hall, LLP

(57) ABSTRACT

A toilet ventilation system for removing unpleasant odors from a toilet efficiently. The toilet ventilation system has a manifold with an inlet that rests on an upper surface adjacent to the toilet bowl. The manifold has an outlet that is in communication with the inlet and the manifold has protrusions that extend from its sides. The protrusions are on cantilevered tabs. The toilet seat has hinges that have mounting portions being spaced apart and including mortices facing inward. The protrusions are designed to snap fit into the mortices and the tabs may be bent inwardly for easy removal of the manifold for cleaning. A fan is connected to the manifold to draw air through the inlet out of the manifold and exhaust the air to a remote location from the toilet and outside of the room where the toilet is located.

17 Claims, 7 Drawing Sheets

U.S. PATENT DOCUMENTS

| | | | | |
|---|---|---|---|---|
| 6,260,214 | B1 * | 7/2001 | Smith | 4/213 |
| 6,463,595 | B2 * | 10/2002 | Prisco et al. | 4/213 |
| 6,523,184 | B2 * | 2/2003 | Prisco | 4/213 |
| 7,117,548 | B1 * | 10/2006 | Reyes | 4/213 |
| 7,120,942 | B2 * | 10/2006 | Kline et al. | 4/213 |
| 7,331,066 | B1 * | 2/2008 | Ramos | 4/213 |
| 7,376,982 | B1 * | 5/2008 | Pencheon | 4/213 |
| 7,797,766 | B2 * | 9/2010 | Ellinger | 4/213 |
| 2002/0032923 | A1 * | 3/2002 | Prisco | 4/213 |
| 2002/0035749 | A1 * | 3/2002 | Prisco et al. | 4/213 |
| 2002/0050002 | A1 * | 5/2002 | Shoptaugh | 4/213 |
| 2002/0148035 | A1 * | 10/2002 | Kang | 4/213 |
| 2003/0028954 | A1 * | 2/2003 | Prisco et al. | 4/213 |
| 2006/0021119 | A1 * | 2/2006 | Kline et al. | 4/213 |
| 2006/0021120 | A1 * | 2/2006 | Nickle | 4/213 |
| 2006/0053537 | A1 | 3/2006 | Vang | |
| 2006/0064804 | A1 * | 3/2006 | Sutton | 4/213 |
| 2006/0085898 | A1 * | 4/2006 | Rosa | 4/213 |
| 2007/0000035 | A1 * | 1/2007 | Belcher | 4/213 |
| 2007/0028373 | A1 | 2/2007 | MacKenzie et al. | |
| 2007/0186334 | A1 * | 8/2007 | Carter et al. | 4/213 |
| 2007/0289052 | A1 * | 12/2007 | Buck | 4/213 |
| 2008/0040842 | A1 * | 2/2008 | Sanabria | 4/213 |
| 2008/0060119 | A1 * | 3/2008 | Pinizzotto | 4/217 |
| 2008/0086799 | A1 | 4/2008 | Bakhchadzyan | |
| 2008/0216220 | A1 * | 9/2008 | Markaj | 4/213 |
| 2010/0043128 | A1 | 2/2010 | Soldera et al. | |
| 2010/0235974 | A1 | 9/2010 | Reed | |

* cited by examiner 10
124
117
120
126
118
16
22
24
20
14
38
40
18
104
11
12
116
117

FIG.6
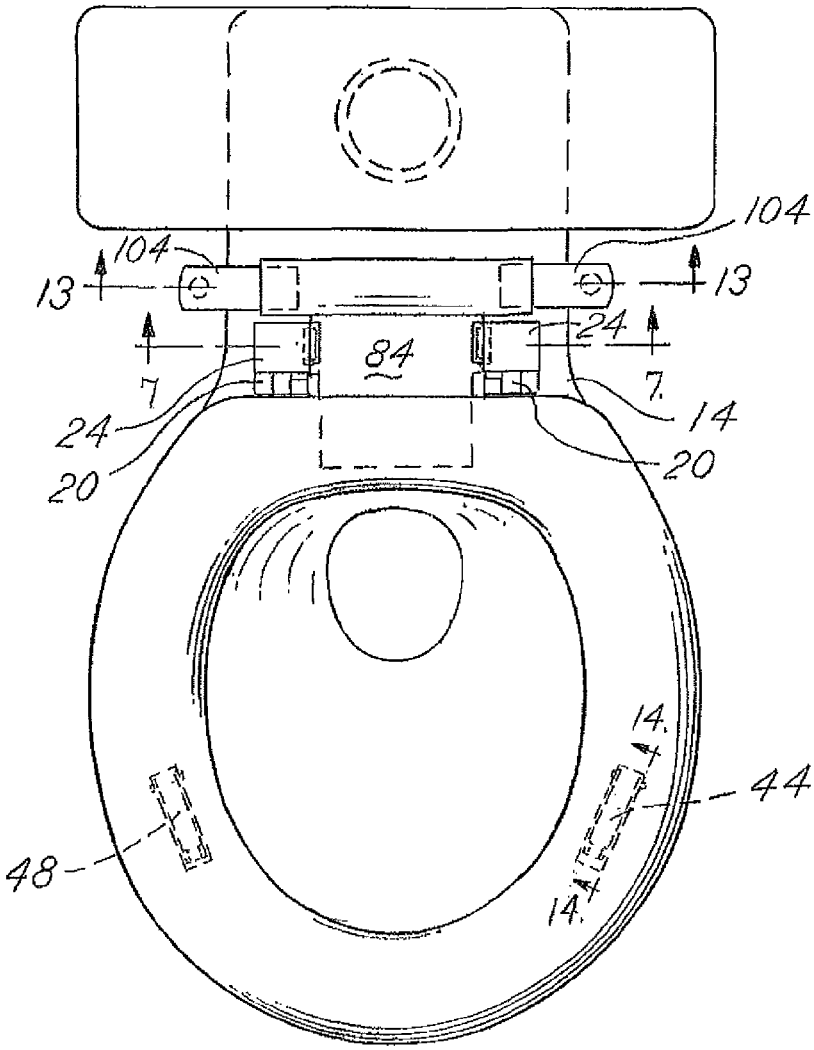
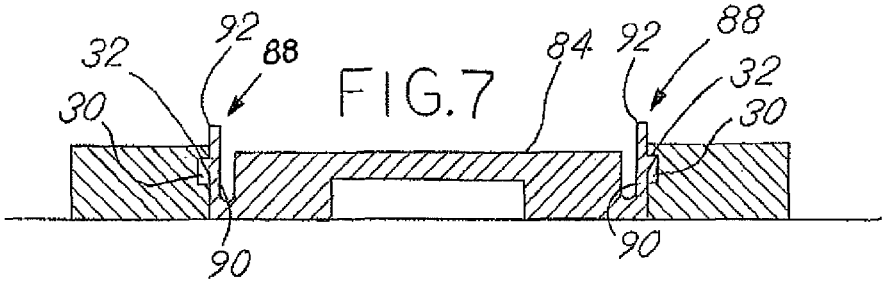
FIG.7
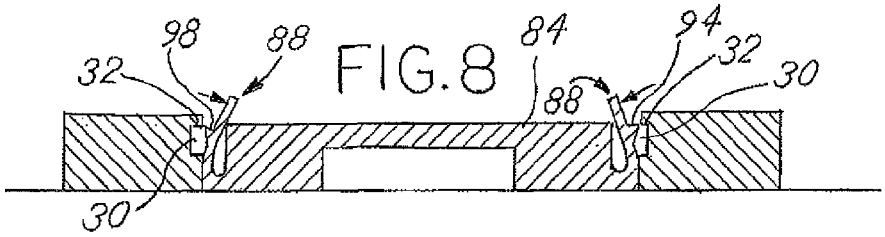
FIG.8

TOILET VENTILATION SYSTEM

CROSS REFERENCE TO RELATED APPLICATIONS

This application is a continuation-in-part claiming the benefit of U.S. application Ser. No. 12/380,876, filed Mar. 4, 2009 now abandoned, the disclosure of which is hereby incorporated by reference.

BACKGROUND OF THE INVENTION

Ventilation of a bathroom having a toilet is well known in the art. For example, it is known to include an exhaust fan drawing air out of the bathroom generally, and often this fan is in the ceiling of the room. This will remove unpleasant odors, but is inefficient. It requires a large amount of air to be evacuated from the room to remove odors. Also drawing air from the room generally does not draw unpleasant odors from their source. Drawing a large amount of air from a bathroom consumes energy due to the fact that the air in the room was likely heated or cooled depending on the season.

Other systems exist that attempt to eliminate the unpleasant odors by collecting air nearer the source of unpleasant odors by collecting air near the toilet have been tried. They have been commercially unsuccessful because of the difficulty in collecting air while necessarily avoiding collection of water.

Another problem of previous toilet ventilation systems is the difficulty in cleaning the toilet and seat area because removing other prior art systems is cumbersome. Existing toilet ventilation systems fail to provide a means for easy removal and therefore, easy cleaning.

SUMMARY OF THE INVENTION

The present invention is a toilet ventilation system for removing unpleasant odors from a toilet efficiently. The toilet ventilation system has a manifold with an inlet that rests on an upper surface adjacent to the toilet bowl. The manifold has an outlet that is in communication with the inlet and the manifold has protrusions that extend from its sides. The toilet seat has hinges that have mounting portions being spaced apart. The mounting portions have mortices in them that are designed to receive the protrusions on the manifold. A fan is connected to the manifold to draw air through the inlet out of the manifold and exhaust the air to a remote location from the toilet and outside of the room where the toilet is located.

The protrusions may be located on cantilevered tabs that extend from the sides of the manifold. The protrusions are designed for a snap fit into the mortices on the mounting portions of the hinges. Bending the cantilevered tabs inward toward the manifold retracts the protrusions from the mortices. This facilitates easy removal of the manifold so that the toilet may be easily cleaned.

BRIEF DESCRIPTION OF THE DRAWINGS

FIG. 6 is a top view of a toilet with the manifold installed between the mounting portions of the hinges;

FIG. 7 is a sectional view taken about the line 7-7 in FIG. 6 showing the protrusions on the cantilevered tabs engaged in the mortices on the mounting portions of the hinges;

FIG. 8 is a sectional view similar to FIG. 7, but with the cantilevered tabs bent inwardly to disengage the protrusions from the mortices on the mounting portions of the hinges;

DETAILED DESCRIPTION OF INVENTION

Figure 1:
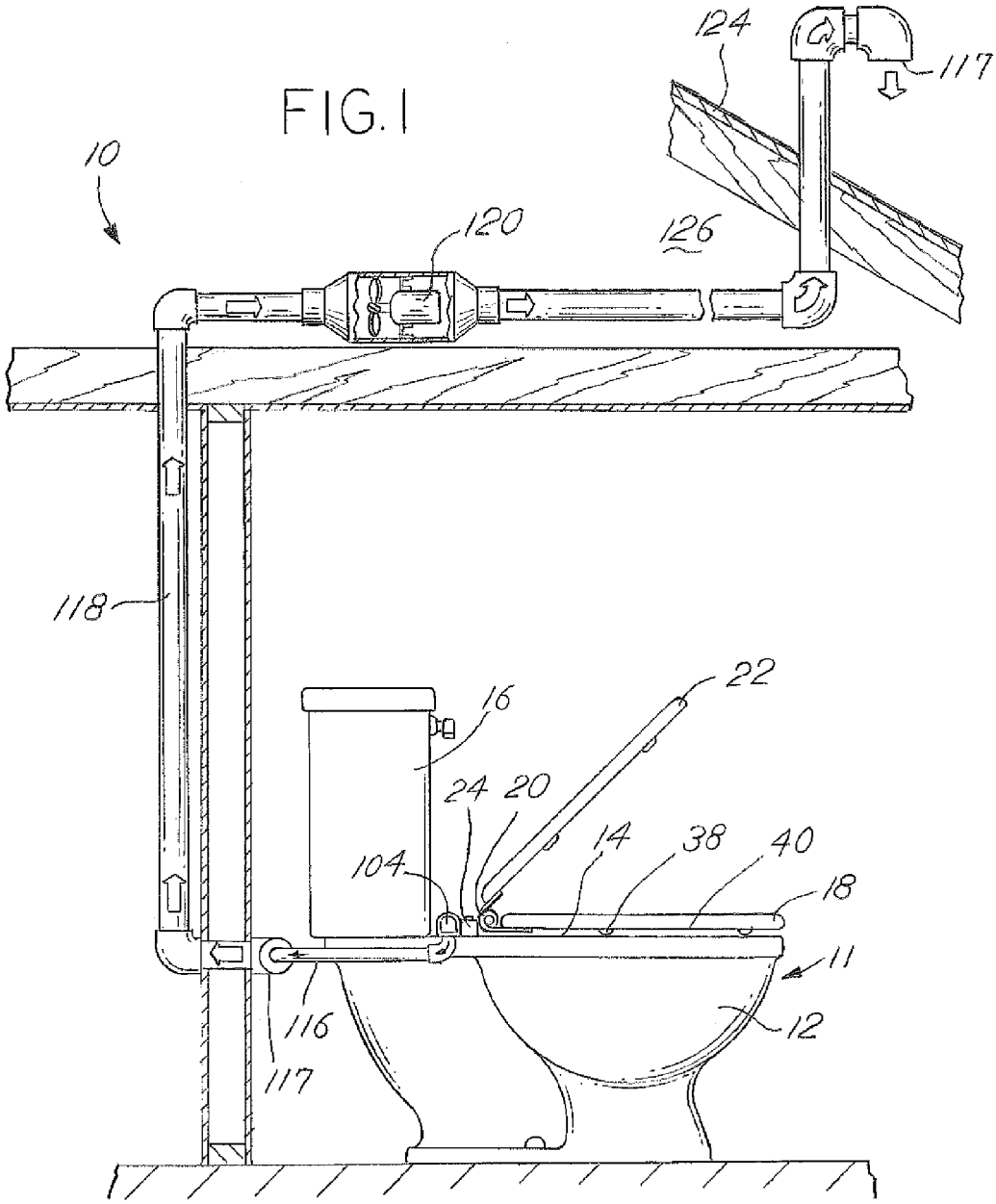
FIG. 1 is a sectional overview of the toilet ventilation system installed in a home.
Figure 2:
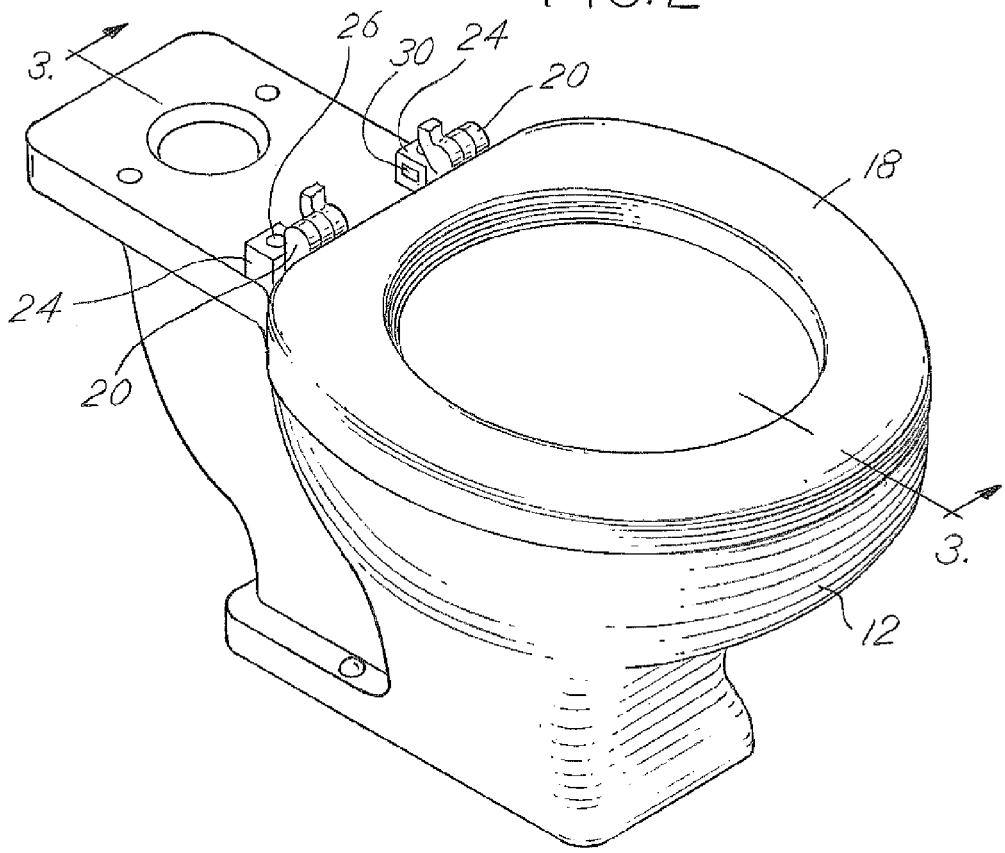
FIG. 2 is a perspective view of a toilet showing the motices in the mounting portions of the hinges.
Figure 3:
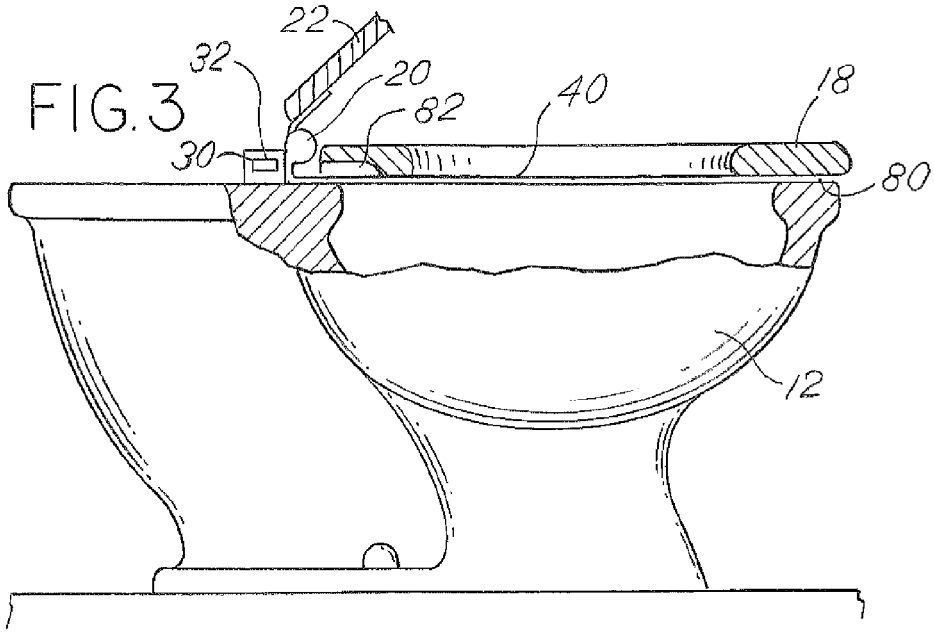
FIG. 3 is a sectional view taken about the line 3-3 in FIG. 2.
Figure 4:
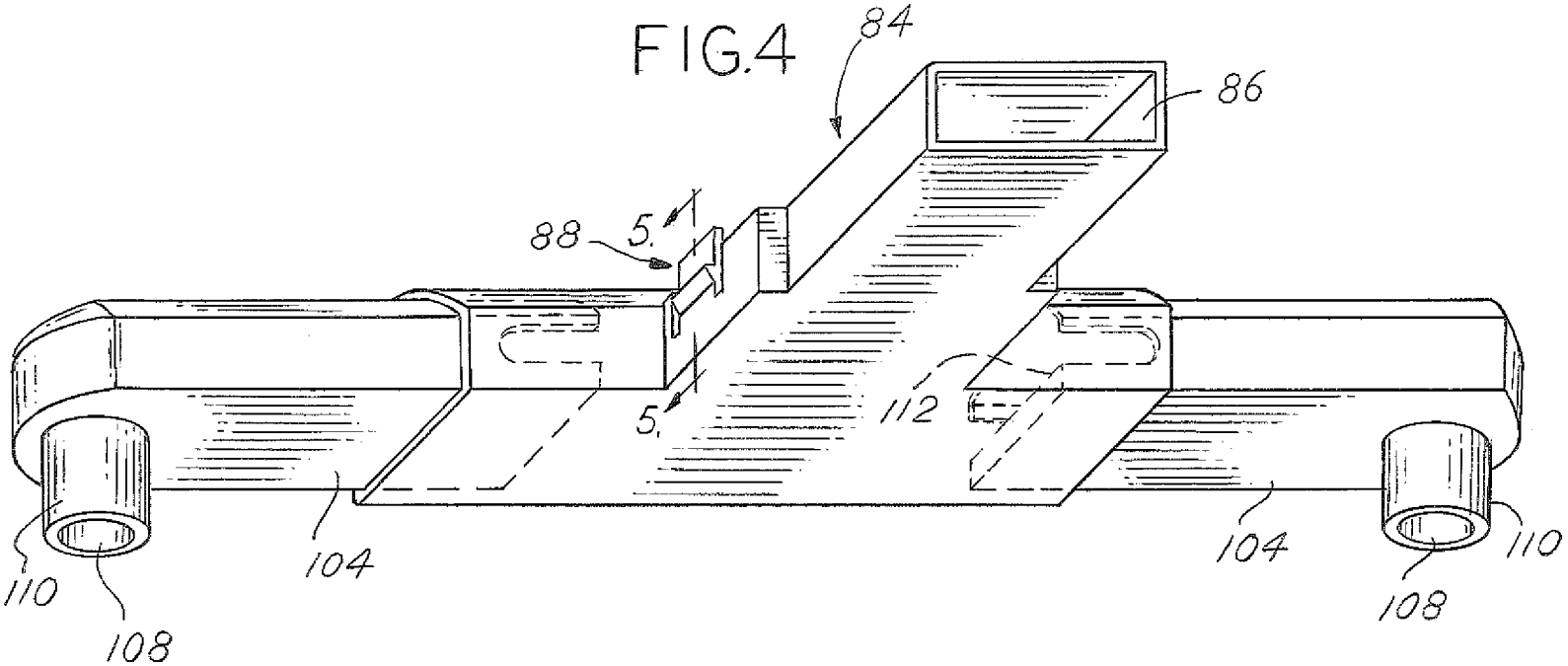
FIG. 4 is a perspective view of the manifold and telescoping sleeves.
Figure 5:
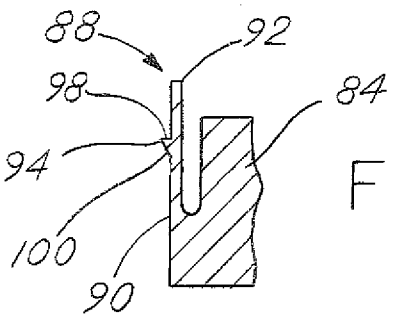
FIG. 5 is a sectional view taken about the line 5-5 in FIG. 4.
Figure 9:
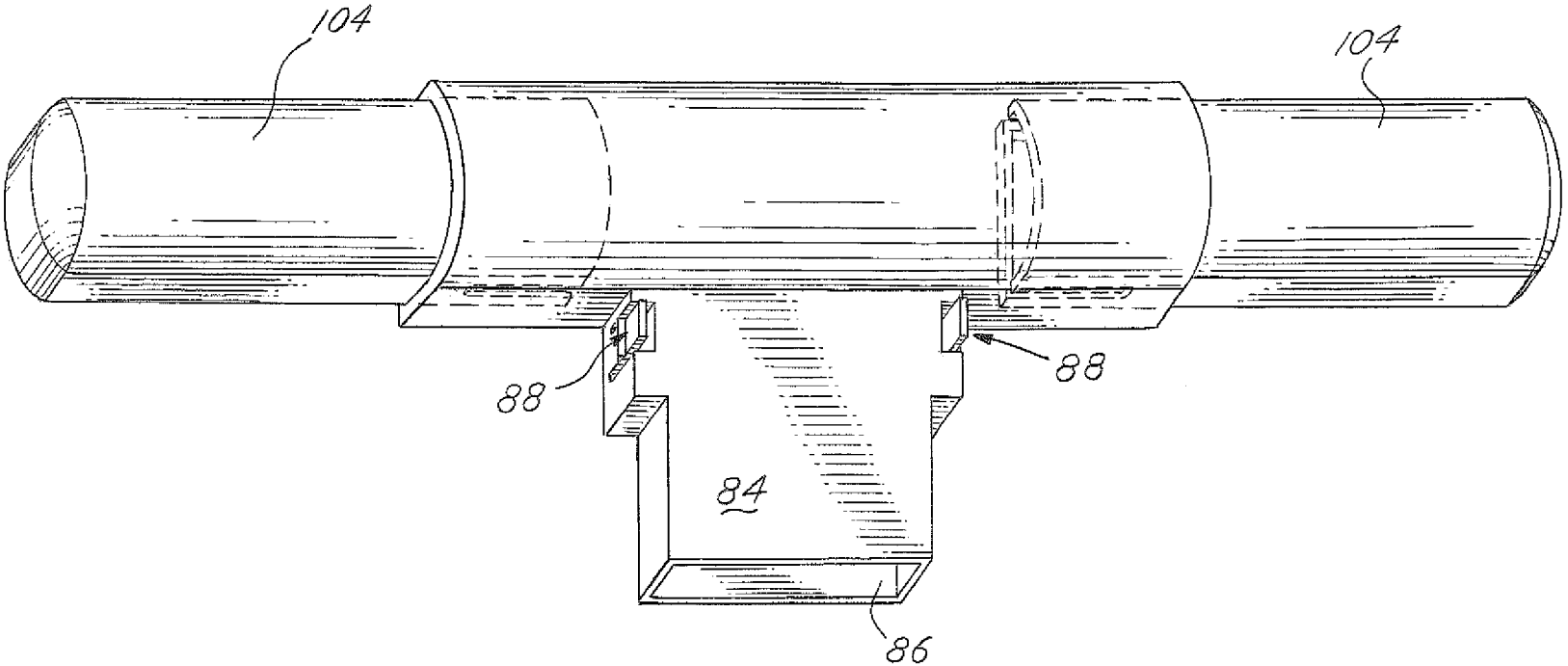
FIG. 9 is a perspective view showing the top of the manifold with the sleeves installed.
Figure 10:
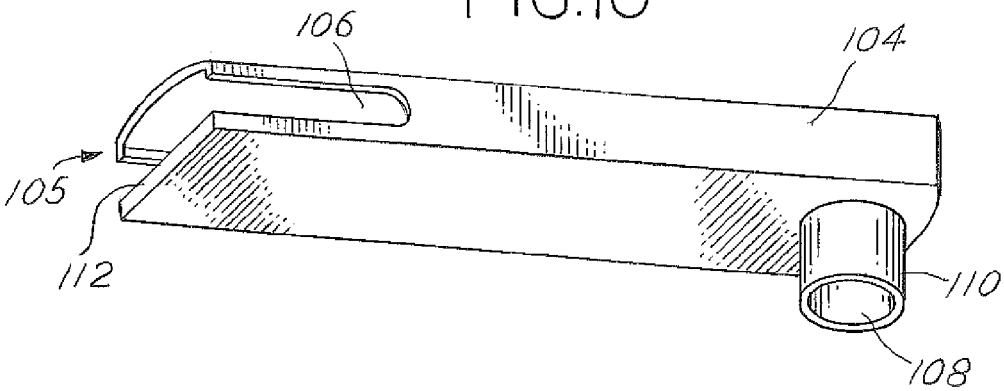
FIG. 10 is a perspective view of one of the sleeves.
Figure 11:
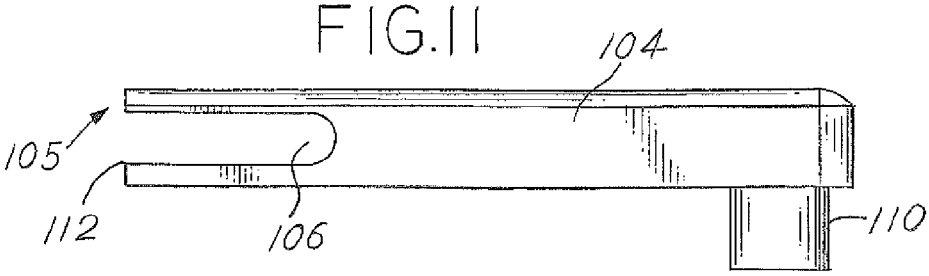
FIG. 11 is a side view of the sleeve shown in FIG. 10.

FIG. 1 shows an overview of the toilet ventilation system 10 installed in a home. The toilet 11 has a bowl 12 that has an upper surface 14 that defines the uppermost portion of the bowl 12. The upper surface 14 extends behind the bowl 12 toward where a tank 16 is mounted to the toilet 11. A seat 18 is attached to the toilet 11 at its upper surface 14 behind the bowl 12 with hinges 20. The hinges 20 are opposite each other and also are pivotally attached to a lid 22. The hinges 20 are typically made of plastic and have mounting portions 24 with holes 26 to receive screws that are driven through the upper surface 14. The screws are not shown, but it is well know to those in the art that such fasteners are typically used to affix the mounting portions 24 to the toilet 11. The mounting portions 24 have mortices 30 that are rectangular recessed pockets. The mortices 30 on the mounting portions are opposite each other and face inwardly. As can be seen in FIGS. 3, 7, and 8, the mortices 30 have flat inner surfaces 32 that are perpendicular to inner faces 34 of the mounting portions. As can be seen in FIG. 6, the upper surface 14 between the tank 16 and bowl 12 has a fixed width that is determined by the manufacturer. This width is large enough to accommodate the spaced mounting portions 24 and the fasteners that hold them to the upper surface 16.

Figure 14:
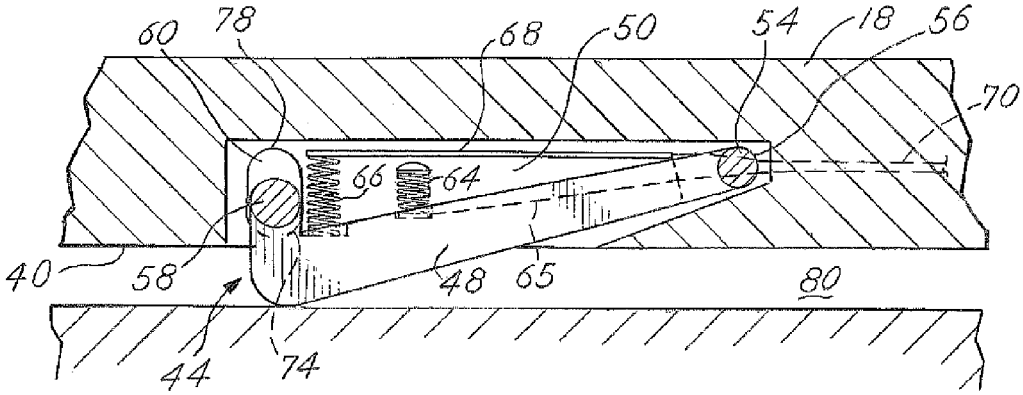
FIG. 14 is a sectional view of the switch taken about the line 14-14 in FIG. 6.
Figure 15:
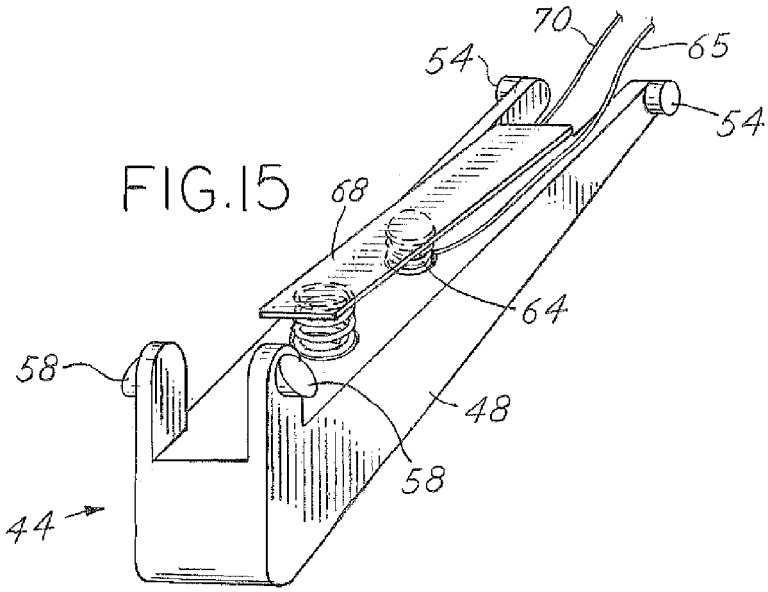
FIG. 15 is a perspective view of the switch outer cover and contacts.

The seat 18 is pivotable about the hinges 20 and rests upon the upper surface. The seat 18 has pads 38 that extend from its lower surface 40 to prevent the lower surface 40 from resting directly on the upper surface 14 of the bowl. The seat 18 also has a switch 44 at a location forward of the pad 38. The location of the switch 44 is shown in FIG. 6. The switch 44 is illustrated in detail in FIGS. 14 and 15. The switch 44 has a cover 48 that is pivotally installed within a recess 50 in the seat 18. The rearmost portion of the cover 48 has hinge pins 54 that snap into rear pockets 56 within the recess 50. The front most portion of the cover 48 has catch pins 58 that are chamfered and are made to catch in front slots 60 within the recess 50 in the seat 18. A first spring 64 attached to the cover 48 includes a first wire 65 extending therefrom and the first spring acts as a first contact in a circuit. A second spring 66 biases the cover 48 away from a second contact 68 that is a metal strip that extends from the second spring 66 toward the hinge pins 54 so that it passes adjacent to the first spring 64. The second contact 68 has a second wire 70 that extends from it. The switch cover 48 has a first position in which the cover 48 is biased until the catch pins 58 are caught against the lowermost end 74 of the slot 60. The first position corresponds to the maximum extension of the second spring 66. The switch cover 48 is pivotable about the hinge pins 54 into a second retracted position in which the second spring 66 is compressed and the first spring 64 contacts the second contact 68. The second spring 66 is chosen to be of a stiffness that will bias the cover 48 away from the seat 18 with a force that will ensure that the first spring 64 does not touch the second contact 68 when the seat 18 is in its down position as shown in FIG. 3. When the force of a person sitting on the seat 18 is present, the force will overcome the second spring 66 and push the cover 48 into its second retracted position, which corresponds to the catch pins 58 being adjacent to the uppermost ends 78 of the slots 60. First spring 64 contacting the second contact 68 completes the circuit between the first wire 65 and second wire 70. A second cover 48 with a single spring may be included on the opposite side of the switch 44 to have even support on both sides of the seat 18 against the upper surface 14. As an be seen in FIG. 3, there is a gap 80 between the seat 18 and the upper surface 14. The seat 18 also includes a rearward facing notch 82 that faces the tank 16.

A manifold 84 is adapted for resting on the upper surface 14 between the seat 18 and the tank 16. The manifold 84 is generally hollow and is made of injection molded plastic. The manifold 84 has an inlet 86 that is rectangular and designed to fit adjacent to the rearmost portion of the seat 18 and adjacent to the notch 82. On the sides of the manifold 84 there are cantilevered tabs 88 that have an attached end 90 at their lowermost portion and a free end 92 that faces upward and extends above the manifold 84. The free ends 92 of the tabs 88 may easily be grasped and bent inward. Upon being bent inward, the tabs 88 being resilient, are biased outward. Each tab 88 has a protrusion 94 on it between the attached end 90 and the free end 92. The protrusion 94 has a flat surface 98 and an angled surface 100 that meet to form an acute angle. The flat surface 98 is on the upper side of the tab facing toward the free end 92, and the angled surface 100 faces the attached end 90. The tabs 88 are spaced so the protrusions 94 extend into the mortices 30 of the mounting portions 24. FIG. 7 shows the spacing of the tabs 88 and the protrusions 94 extending into the mortices 30. The tabs 88 can be bent inwardly, as shown in FIG. 8, so that the protrusions 94 are retracted from the motrices 30. The angled surfaces 100 on the protrusions 94 urges the tabs 88 inward when the manifold 84 is pushed down between the mounting portions 24, and after the protrusions 94 are adjacent to the mortices 30, the tabs 88 will snap the protrusions 94 into the mortices as shown in FIG. 7. This results in the manifold 84 being held in place between the mounting portions 24.

Figure 12:
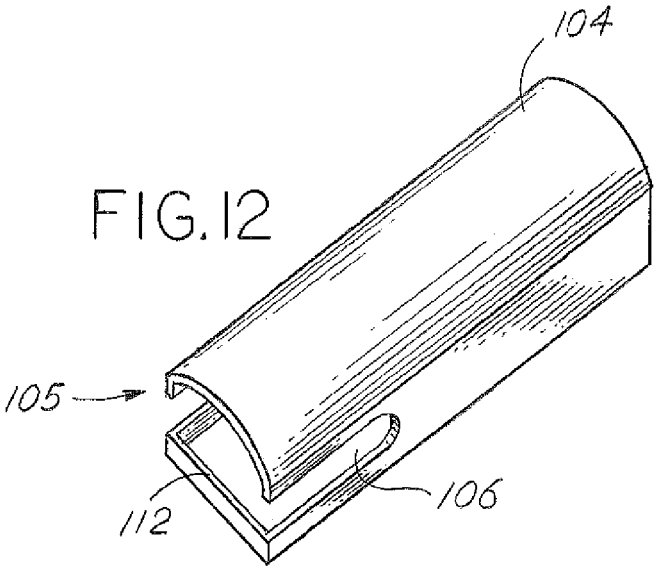
FIG. 12 is a perspective view of the sleeve shown in FIGS. 10 and 11 showing the dam.
Figure 13:
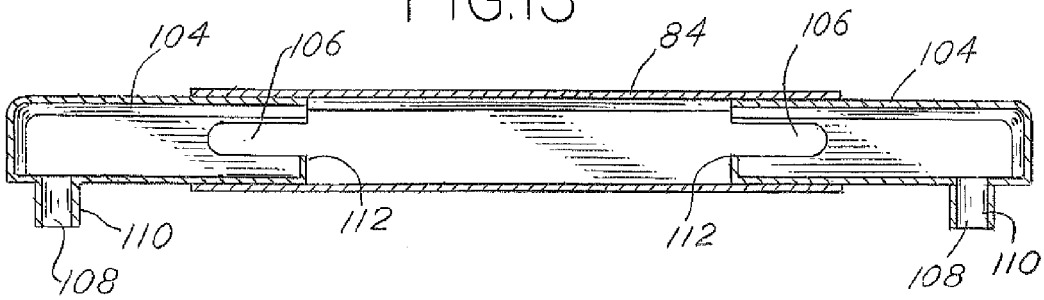
FIG. 13 is a sectional view taken about the line 13-13 in FIG. 6.

The manifold 84 holds sleeves 104 in a telescoping manner within itself. The inner end 105 of the sleeves include a notch 106 allowing the inner end to flex some as it moves slidingly within the manifold 84. In addition to close dimensional tolerances with the inside of the manifold 84 and the outside of each sleeve 104, the resilient flexing of the inner end 105 of the sleeves helps provide an airtight seal between the sieves 104 and the manifold 84. The sleeves 104 are adjustable in their width to accommodate the upper surface 14 between the seat 18 and tank 16. As known to those skilled in the art, this surface can vary between different toilet manufacturers. The sleeves 104 provide for a wide range of adjustment and will even allow air to be drawn through them when the ends 105 touch each other because the notches 106 will allow air to be drawn from the sleeves 104. The sleeves 104 are hollow and are in communication with the inlet 86. Each sleeve 104 has an outlet 108 that has a raised collar 110. Inside each sleeve 104 is a dam 112, that is on the lower side inside the sleeves 104. The dam 112 is most clearly seen in FIG. 12. The dam 112 prevents the inadvertent flow of water into the sleeves should water accidentally enter the inlet 86, which could happen if the toilet 11 were to overflow.

The collars 110 are designed to accommodate outlet pipes 116 that lead into a main outlet pipe 118. The outlet pipes 116 connected to the sleeves 104 may be attached to the collars 110 using pipe clamps wire ties, or other methods known to those skilled in the art. The pipes 116 themselves can be of any flexible, rigid, or semi rigid material that can be joined to an outlet tee 117 that leads into a main outlet pipe 118. The pipes 116 are connected to each sleeve 104 so they straddle the upper surface 14 and the pair of pipes 116 join together in an outlet tee 117. Having an outlet tee 117 allows for the use of smaller pipes than the main outlet pipe 118 inside the home near the toilet 11, yet still allows for a large amount of air flow. The main outlet pipe 118 includes a fan 120. The fan exhausts air drawn in through the manifold 84. The end 117 of the main outlet pipe 118 may be out of a roof 124 as shown in FIG. 1, or could be in an attic space 126 if an installer does not wish to cut a hole in the roof 124.

The use of the toilet ventilation system 10 is simple and does not require any significant alterations of the user's ordinary use of the toilet 11. In the case of the system 10 including an integrated switch 44 the user will simply put the seat down in a normal fashion and upon sitting on the seat 18, the fan 120 will draw air into the inlet 86. This will remove any odors emanating from the bowl 12. In this embodiment of the invention, the wires 65 and 70 will be connected when the first spring 66 touches the second contact 68. This will connect the fan 120 to a power source, which is usually the wiring of the home in which it is installed. The wires 65, 70 can be molded into the seat so they may be discretely routed behind the toilet 11 to the fan 120. As such, the outward appearance of the toilet 11 will be substantially unchanged. It is also contemplated that in some installations, a seat 18 without a switch may be used. In this case, a wall switch near the toilet is included to start the fan 120 when a user wishes to use the toilet.

The present invention is not limited to the details given above, but may be modified within the scope of the following claims.

What is claimed is:

1. A toilet ventilation system for removing odors from a toilet having a bowl and an upper surface defining the uppermost portion of said bowl, said ventilation system comprising:

a toilet seat adapted for resting on said upper surface of said toilet, said seat having a hinge including a pair of mounting portions spaced from each other adapted for being affixed to said upper surface of said toilet, said mounting portions including mortices that face each other;

a manifold having an inlet for directing air into said manifold, an outlet in communication with said inlet and extending from said manifold, and protrusions being adapted for fitting into said mortices;

a hose connected to said manifold for drawing air from said outlet; and a fan connected to said hose for drawing from said outlet, said fan exhausting air drawn from said hose and manifold to a location remote of said inlet of said manifold, wherein said protrusions include a chamfer and a flat surface, said flat surface and said chamfer forming an acute angle, said flat surface adapted for catching in said mortices, said protrusions being biased outwardly from said manifold.

2. A toilet ventilation system as claimed in claim 1, wherein said protrusions extend from cantilevered tabs, an attached end of each said tab being affixed to said manifold, said protrusions being spaced from said attached end so that said tab resiliently biases said protrusions outwardly from said manifold.

3. A toilet ventilation system as claimed in claim 2, wherein said tabs have an unattached end extending above said manifolds.

4. A toilet ventilation system as claimed in claim 2, wherein said manifold includes a pair of hollow sleeves telescopingly held within said manifold, said sleeves including said outlet.

5. A toilet ventilation system as claimed in claim 4, wherein said seat includes pressure sensitive switches for selectively connecting said fan to a power source when a predetermined pressure pushes said seat against said upper surface of said toilet.

6. A toilet ventilation system as claimed in claim 5, wherein said seat includes a notch located between said hinges, said notch adapted for receiving said inlet of said manifold.

7. A toilet ventilation system as claimed in claim 6, wherein said sleeves include a dam located between said outlet and said inlet of said manifold to prevent the flow of liquid through said sleeves and into said outlet.

8. A toilet ventilation system as claimed in claim 1, wherein said protrusions are located on cantilevered tabs having an attached end connected to said manifold and a free end opposite said manifold, said tabs adapted for resiliently biasing said protrusions outward.

9. A toilet ventilation system as claimed in claim 8, wherein said protrusions include a chamfer and a flat surface, said flat surface and said chamfer forming an acute angle, said flat surface adapted for catching in said mortices.

10. A toilet ventilation system as claimed in claim 8, wherein said seat includes a switch for selectively opening and closing a circuit connecting said fan to a power source.

11. A toilet ventilation system as claimed in claim 10, wherein said switch includes an outer cover pivotally connected to said seat at one end, said cover being pivotable between a first extended position and a second retracted position, said spring spaced from said one end and biasing said cover away from said seat, a first contact on said cover and a second contact spaced from said cover so that said first and second contacts touch to complete said circuit when said cover is in its retracted position.

12. A toilet ventilation system as claimed in claim 11, wherein said second contact is a spring.

13. A toilet ventilation system for removing odors from a toilet having a bowl and an upper surface defining the uppermost portion of said bowl, said upper surface extending behind said bowl, said ventilation system comprising:

a toilet seat adapted for resting on said upper surface of said toilet, said seat having a pair of hinged mounting portions hingeably attached to said seat, said mounting portions including mortices opposed to each other and inwardly facing each other;

a manifold adapted for fitting between said mounting portions and having an inlet for directing air into said manifold, an outlet in communication with said inlet and extending from said manifold, and outwardly extending protrusions adapted for extending into said mortices;

a hose connected to said outlet of said manifold; and a fan connected to said hose for drawing air from said outlet, said fan exhausting air drawn from said hose and manifold to a location remote of said inlet of said manifold, wherein said protrusions are located on cantilevered tabs having an attached end connected to said manifold and a free end opposite said manifold, said tabs adapted for resiliently biasing said protrusions outward.

14. A toilet ventilation system as claimed in claim 13, wherein said protrusions include a chamfer and a flat surface, said flat surface and said chamfer forming an acute angle, said flat surface adapted for catching in said mortices.

15. A toilet ventilation system as claimed in claim 13, wherein said seat includes a switch for selectively opening and closing a circuit connecting said fan to a power source.

16. A toilet ventilation system as claimed in claim 15, wherein said switch includes an outer cover pivotally connected to said seat at one end, said cover being pivotable between a first extended position and a second retracted position, said spring spaced from said one end and biasing said cover away from said seat, a first contact on said cover and a second contact spaced from said cover so that said first and second contacts touch to complete said circuit when said cover is in its retracted position.

17. A toilet ventilation system as claimed in claim 16, wherein said second contact is a spring.

* * * * *